United States Patent [19]

Bigelow

[11] 3,977,879

[45] Aug. 31, 1976

[54] PHOTOGRAPHIC ELEMENT WITH CONTIGUOUS LAYER CONTAINING AN OXIDIZING AGENT

[75] Inventor: John Howard Bigelow, Rochester, N.Y.

[73] Assignee: E. I. Du Pont de Nemours and Company, Wilmington, Del.

[22] Filed: Dec. 20, 1974

[21] Appl. No.: 535,137

[52] U.S. Cl. ..... 96/95; 96/108

[51] Int. Cl.[2] ..... G03C 1/06; G03C 1/28

[58] Field of Search ..... 96/108, 95, 109, 66, 96/66.3

[56] References Cited

UNITED STATES PATENTS

| | | | |
|---|---|---|---|
| 3,249,440 | 5/1966 | Hunt | 96/108 |
| 3,313,624 | 4/1967 | Gutoff | 96/29 |
| 3,594,172 | 7/1971 | Sincius | 96/107 |
| 3,615,534 | 10/1971 | Tajima et al. | 96/67 |

*Primary Examiner*—Mary F. Kelley

[57] ABSTRACT

Photographic elements having a radiation-sensitive, colloid - silver halide emulsion layer and a contiguous light-insensitive layer containing an oxidizing agent selected from the group consisting of iodine and potassium iodate.

6 Claims, No Drawings

PHOTOGRAPHIC ELEMENT WITH CONTIGUOUS LAYER CONTAINING AN OXIDIZING AGENT

BACKGROUND OF THE INVENTION

1. Field of the Invention

This invention relates to photographic silver halide elements having improved speed and increased sharpness in halftone images when developed in hydroquinone developers.

2. Description of the Prior Art

Hunt U.S. Pat. No. 3,249,440 patented May 3, 1966 is directed to the use of molecular iodine in radiation-sensitive, direct-writing, light-developable silver halide emulsion layers.

Duennebier et al. U.S. Pat. No. 3,297,445 patented May 10, 1967 deals with inhibitor releasing developers which are incorporated in the emulsion layers or in hydrophilic layers contiguous thereto and comprise iodoquinones. The compounds are alleged to release iodine at or near the site of development when reacted with sulfite ions although the reactions shown appear to contradict this in that only iodide ions are shown to be released.

De Munch et al., U.S. Pat. No. 3,617,284 patented Nov. 2, 1971 describes a process of developing a lith-type negative silver halide emulsion in the presence of an N-vinyl-2-pyrrolidone polymer with hydroquinone developer containing alkylene oxide units. The iodine complexes of the polymer may also be used and the polymers may be incorporated in either the emulsion layer or a layer contiguous with the emulsion layer. The iodine complexes are described as addition complexes (addition by inclusion) of molecular iodine with the N-vinyl-2-pyrrolidone polymer.

Milton, U.S. Pat. No. 3,697,281 patented Oct. 10, 1972 describes the use of strong oxidizing agents in fogged direct-positive emulsions for improved speed vs. maximum density characteristics.

SUMMARY OF THE INVENTION

This invention provides for a light-sensitive, silver halide photographic material comprising a support coated with a light-sensitive, negative-type colloid silver halide emulsion layer and at least one layer contiguous to said emulsion layer comprising a water permeable hydrophilic colloid containing at least one oxidizing agent selected from the group consisting of iodine, potassium iodate, ceric ammonium nitrate and potassium perchlorate. By negative-type silver halide emulsion is meant one wherein by exposure a latent image is formed in the exposed areas and chemical development produces an image in the exposed areas. The invention also provides a process for developing these emulsions with a hydroquinone (HQ) developer either of the high-contrast lithographic halftone type or the continuous tone type.

Addition of the oxidizing agents to the emulsion layer as opposed to a contiguous layer can destroy developer response by attacking sensitizing dyes, sensitivity centers, or the latent image itself depending upon the strength and amount present, etc. In this invention it has been found, surprisingly, that the addition of the oxidizing agent in a contiguous layer minimizes the above disadvantageous attacks on developer response. Because of the position of the oxidizing agent in a light-insensitive overcoating or undercoating layer contiguous with the emulsion layer, said oxidizing agent is believed to more readily react with the mobile hydroquinone in the developer solution than with the silver of the latent image and thus produces development acceleration. In the case of iodine, the effect may be illustrated by the equation $$HQ^{-2} + \tfrac{1}{2} I_2^{\circ} \rightarrow HQ^{-1} + I^{-1}$$

wherein the formation of the semiquinone increases development activity.

DESCRIPTION OF THE PREFERRED EMBODIMENTS

In a preferred embodiment, the oxidizing agent is incorporated in the antiabrasion layer of the photographic element. The compound may also be incorporated in an underlayer contiguous with the emulsion layer.

The silver halide emulsion may be of any of the usual negative types used for radiographic purposes, cine films, graphic arts or portrait use. The silver halide crystals may also be any of the usual types such as silver chloride, silver bromide, silver bromochloride, silver iodobromide, etc. Particularly useful results have been obtained with lithographic films containing silver bromochloride crystals. Gelatin is the preferred binder for the silver halide crystals, but it may be replaced partially with other natural or synthetic binders as is known in the art. Thus, binders used to increase covering power, e.g., dextran, dextrin, polyvinyl pyrrolidone, etc., as well as latices of polymers such as polyethyl acrylate which are useful in improving dimensional stability are advantageously included in many types of silver halide emulsions employed in this invention. The latices of polymers are particularly useful in lithographic films as taught by Nottorf, U.S. Pat. No. 3,142,568, patented July 28, 1964 and U.S. Pat. No. 3,325,286 patented June 13, 1967.

The range of concentration of the oxidizing agent in the light-insensitive contiguous layer depends somewhat on the emulsion, the concentration of hydroquinone in the developer, and the thickness of said contiguous layer. The concentration is best expressed in terms of the quantity of oxidizing agent per unit quantity of gelatin binder which is coated to give about 10–30 mg/dm$^2$. The concentration of oxidizing agent may range from 0.003 to 0.08 gram per gram of gelatin in the contiguous light-insensitive layer.

The light-insensitive layer containing the oxidizing agent, which is normally the antiabrasion or overcoating layer, conveniently has gelatin as the binder. However, the gelatin can be replaced in part, with other hydrophilic colloid binders as stated above. A typical overcoating layer is coated from an aqueous solution of gelatin containing the oxidizing agent, coating aids and hardeners such as aldehydes, e.g., formaldehyde, chrome alum, etc., to give a layer containing approximately 20 mg/dm$^2$. Suffice it to say that it is only necessary to have a sufficient amount of oxidizing agent to satisfy the above equation and provide enough semiquinone to reduce the induction period of development. Only those oxidizing agents indicated above have been found to be satisfactory.

The support for the photographic elements preferably is a polyethylene terephthalate film base as described in Alles, U.S. Pat. No. 2,627,088 patented Feb. 3, 1953, but other coated and uncoated supports including those listed in Cohen et al., U.S. Pat. No.

3,252,801 patented May 24, 1966 can be used. Any of the usual emulsion adjuvants may be present in the silver halide layer, e.g., emulsion sensitizers, sensitizing dyes, coating aids, etc.

The invention will be further illustrated by but is not intended to be limited to the following examples.

EXAMPLE I

A high speed silver halide emulsion was prepared containing 1.67 mole percent silver iodide and the rest silver bromide and sensitized with an orthochromatic sensitizing dye, gold and sulfur compounds and digested in a conventional manner all of which is well known in the art. After coating and drying on a photographic film support samples of the coatings were overcoated with a 1.1% aqueous gelatin solution containing the oxidizing agents listed in Table I below, in a quantity per gram of gelatin as shown in the table. The iodine was added as an ethyl alcohol solution, but the other agents were added as aqueous solutions. One sample was used as a control and contained no oxidizing agent in the overcoating solution.

Samples of the resulting coatings were exposed on an Edgerton, Germeshausen and Grier Sensitometer Mark X at $10^{-6}$ seconds through a $\sqrt{2}$ step wedge, processed 2 minutes at 80°F and developed in a conventional formaldehyde-bisulfite-hydroquinone lithographic developer.

The developed strips were fixed, washed, and dried and the sensitometric properties were determined in a conventional manner and are shown in the following table.

TABLE I

| Coating No. | Oxidizing Agent In Overcoating Gram/Gram of Gel | Minimum Density | Maximum Density | Relative Speed at Density =1.5 | Gamma Density =0.3 to 3.0 |
|---|---|---|---|---|---|
| 1 | None-Control | .05 | 4.0 + | 100 | 2.81 |
| 2 | .0163 $I_2$ | .06 | 4.0 + | 300 | 2.47 |
| 3 | .0272 $KIO_3$ | .05 | 4.0 + | 310 | 3.27 |
| 4 | .0701 $(NH_4)_2Ce(NO_3)_6$ | .05 | 4.0 + | 213 | 4.0 |
| 5 | .0177 $KClO_4$ | .05 | 4.0 + | 238 | 2.65 |

It is concluded from the above data that all of the oxidizing agents increase speed over the control.

EXAMPLE II

A silver iodobromide emulsion was made, coated and dried as described in Example I. One emulsion layer was overcoated with a 1.1% aqueous gelatin containing no oxidizing agent while a second emulsion layer was overcoated with a similar gelatin solution containing 0.0163 grams of iodine per gram of gelatin. The two resulting elements were exposed and tested as described in Example I except that the strips were developed for 60 and 120 seconds in a conventional lithographic developer.

The results are shown in the following table.

TABLE II

| Ctg. No. | Gram $I_2$/Gram Gelatin | Processing Time | Min. Dens. | Max. Dens. | Speed Dens. =.25 | Speed Dens. =3.25 | Gamma Density 0.25–3.25 |
|---|---|---|---|---|---|---|---|
| 1 | None-Control | 60 sec. | .06 | 4.0 + | 100 | 100 | 2.94 |
| 2 | 0.0163 | 60 sec. | .11 | 4.0 + | 500 | 370 | 2.63 |
| 3 | None-Control | 120 sec. | .11 | 4.0 + | 100 | 100 | 3.18 |
| 4 | 0.0163 | 120 sec. | .16 | 4.0 + | 120 | 96 | 2.90 |

The data indicates that $I_2$ in a gelatin overcoating acts as a development accelerator during the early stages of processing with the acceleration falling off in later stages.

EXAMPLE III

A photographic film base of the type described in Alles U.S. Pat. No. 2,627,088 was coated with 3% aqueous gelatin solutions, one of which contained no oxidizing agent, two other coatings contained 0.0033 gram and 0.0163 gram of iodine per gram of gelatin respectively. Two silver iodobromide emulsions were made as described in Example I with the following exceptions. During the digestion stage the two emulsions were treated as follows:

| Additives | Emulsion A | Emulsion B |
|---|---|---|
| KI | 0.0012 mole per 1.5 moles of silver halide | none |
| Citric acid | none | 0.04 mole per 1.5 moles silver halide |
| Coating pH | 7.4 | 5.4 |

The two emulsions were each coated on a set of three of the overcoated film bases described above.

The emulsions were exposed and processed in a Rolor automatic processing machine manufactured by the Rolor Corporation, Soyosset, L. I., N.Y. for 120 seconds at 80°F using the developer of Example II above to give the results in the following table.

TABLE III

| Ctg. No. | Quantity of $I_2$ in Undercoating | Relative Speed Dens. =.25 | Relative Speed Dens. =3.25 | Max. Dens. | Average Gradient | Fog |
|---|---|---|---|---|---|---|
| A-1 | Control- | | | | | |

TABLE III-continued

| Ctg. No. | Quantity of $I_2$ in Undercoating | Relative Speed Dens. =.25 | Relative Speed Dens. =3.25 | Max. Dens. | Average Gradient | Fog |
|---|---|---|---|---|---|---|
| | none | 100 | 100 | 4.97 | 15.5 | .05 |
| A-2 | 0.0033 | 100 | 85 | 4.21 | 16.26 | .06 |
| A-3 | 0.0163 | 800 | 1040 | 5.30 | 22.22 | .09 |
| B-1 | Control-none | 100 | 100 | 4.08 | 19.60 | .05 |
| B-2 | 0.0033 | 85 | 150 | 4.72 | 30.30 | .05 |
| B-3 | 0.0163 | 400 | 640 | 5.30 | 35.08 | .05 |

The above data show that greater speed, maximum density and contrast can be obtained by adding iodine to an undercoating as part of the photographic structure whether or not potassium iodide is added to the emulsion and whether the coating pH is relatively low or high. This indicates that the improved results are not due to the Lainer effect (A. Lainer, Phot. Korr. 28, 12 (1891). Lainer found that bathing exposed emulsion layers in dilute iodide solutions accelerated development.

EXAMPLE IV

A set of sample coatings from Example II were exposed as described therein but developed at 68°F in a conventional continuous tone hydroquinone developer.

The sample coatings were fixed, washed, and dried and the following sensitometric results were obtained.

TABLE IV

| Ctg. No. | Overcoating Iodine Content | Min. Dens. | Max. Dens. | Relative Speed Dens.=0.25 | Relative Speed Dens.=3.5 |
|---|---|---|---|---|---|
| 1 | None-Control | .06 | 5.6 | 100 | 100 |
| 2 | 0.0163 gram/gr. gelatin | .06 | 5.6 | 153 | 154 |

The above data indicates that the presence of iodine in the overcoating increases the effective speed in continuous tone developers as well as lithographic developers.

EXAMPLE V

A silver halide emulsion having a silver halide content of 30 percent silver bromide and 70% silver chloride was prepared in a conventional manner, i.e. precipitation of silver halides in aqueous gelatin, coagulation washing to remove unwanted soluble salts and redispersing the emulsion in the manner taught by Moede, U.S. Pat. No. 2,772,568 patented Nov. 27, 1956. Bulking gelatin was added together with ethyl acrylate polymer latices to give, per 1.5 moles of silver halide, 70 grams of gelatin and 24 grams of the polymer latex in the manner taught by Nottorf, U.S. Pat. No. 3,142,568 patented July 28, 1964. The emulsion was coated on photographic film base and dried in the conventional manner. The coated film was divided into three samples and the samples were overcoated with 1.1% aqueous gelatin solutions containing the oxidizing agents indicated in the table below. The samples were given an exposure of 32 meter-candle seconds in a vacuum frame using a $\sqrt{2}$ film step wedge and a 100 lines/inch negative square dot, contact, gray screen. The exposed samples were developed in the developer set forth in Example II using a Pakorol Processor CTS manufactured by Pako, Minneapolis, Minn. for the development periods shown in the table. The developed samples were judged for dot quality and an arbitrary scale of 1 to 4 was used to judge this quality by visual observation with the higher numbers indicating the better, sharper halftone dots.

TABLE V

| Ctg. No. | Overcoating Additions Grams/Gram of Gelatin | HALFTONE DOTS 90 sec. Dev. 90% | 50% | 10% | 120 sec. Dev. 90% | 50% | 10% |
|---|---|---|---|---|---|---|---|
| 1 | None-Control | 3 | 2 | 1 | 3 | 3 | 1 |
| 2 | 0.0165 $I_2$ | 3 | 3 | 2 | 3 | 3 | 2 |
| 3 | 0.0278 $KIO_3$ | 3 | 3 | 2 | 3 | 3 | 1 |

Data in this table show that those samples which contain oxidizing agents in the overcoating produce sharper halftone dots and the difference is greater for the shorter processing time and smaller dots.

EXAMPLE VI

Example V was repeated only a silver halide emulsion was prepared comprising 90% silver chloride and 10% silver bromide. Under the same exposure and processing conditions the following results were obtained.

TABLE VI

| Ctg No. | Gram Oxidizing Agent /Gram Gelatin | Min. Dens. | Max. Dens. | Speed Dens. =0.25 | Speed Dens. =3.25 | HALFTONE DOT QUALITY (90 Second Processed) 90% | 50% | 10% |
|---|---|---|---|---|---|---|---|---|
| 1 | None-Control | .04 | 5.45 | 100 | 100 | 3 | 2 | 1 |
| 2 | 0.0165 $I_2$ | .04 | 5.53 | 102 | 93 | 3 | 3 | 2 |
| 3 | 0.0278 $KIO_3$ | .04 | 5.75 | 104 | 96 | 3 | 3 | 2 |
| 4 | 0.0390 $KClO_4$ | .04 | 5.41 | 150 | 113 | 3 | 3 | 2 |
| 5 | 0.07$(NH_4)_2Ce(NO_3)_6$ | .04 | 5.13 | 144 | 80 | 3 | 2 | 2 |

The above data indicate that the oxidizing agents in the overcoatings improve halftone dot quality without extensively affecting the sensitometry.

EXAMPLE VII

Emulsions were prepared and overcoated as in Example V except that the gelatin/ethyl acrylate polymer ratios in the emulsions prepared were 2/1 and 1/1 and the gelatin overcoatings contained gelatin and ethyl acrylate polymer latex in a ratio of 1/1. The overcoatings contained 0.01 gram and 0.02 gram of iodine per gram of gelatin. The emulsions were exposed and developed for 120 seconds at 80°F in the developer of Example II.

The results are shown in the following table.

TABLE VII

| Ctg. No. | Gram $I_2$/g of Overcoating Gelatin | Ratio of Gelatin/Latex In Emulsion | Ratio of Gelatin/Latex In Overcoating | Halftone Dot Quality* 90% | 50% | 10% |
|---|---|---|---|---|---|---|
| 1 | None-Control | 2/1 | 1/1 | 3 | 3 | 1 |
| 2 | 0.01 Gram | 2/1 | 1/1 | 3 | 4 | 3 |
| 3 | 0.02 Gram | 2/1 | 1/1 | 3 | 4 | 3 |
| 4 | None-Control | 1/1 | 1/1 | 3 | 2 | 1 |
| 5 | 0.01 Gram | 1/1 | 1/1 | 3 | 4 | 2 |
| 6 | 0.02 Gram | 1/1 | 1/1 | 3 | 4 | 2 |

*Higher numbers denote better, sharper halftone dots.

The data show that the addition of iodine in an overcoating produces improved halftone dot quality even in the presence of considerable ethyl acrylate latex. Addition of $I_2$ shows improvement in the 10% dots indicating that development starts sooner and produces harder dots.

I claim:

1. In a process wherein a photographic element comprising a radiation-sensitive, negative-type colloid-silver halide emulsion layer and a second layer which is contiguous to said emulsion layer is coated on a support and subsequently exposed to form a latent image which is developed in a formaldehyde-bisulfite-hydroquinone lithographic developer to produce an image in the exposed areas, the improvement comprising increasing the development speed and improving the halftone dot quality by incorporating in the aforesaid second layer an oxidizing agent selected from the group consisting of iodine and potassium iodate.

2. The process of claim 1 wherein said contiguous layer contains gelatin as the binder.

3. The process of claim 2 wherein the oxidizing agent is present in the said contiguous layer in an amount of from 0.003 to 0.08 grams per gram of gelatin.

4. The process of claim 1 wherein the contiguous layer is an antiabrasion layer having from 10 to 30 mg of gelatin per $dm^2$.

5. The process of claim 1 wherein the contiguous layer is an underlayer interposed between the emulsion layer and the support.

6. The process of claim 1 wherein the oxidizing agent is iodine.

* * * * *